US006412957B1

(12) United States Patent
Oba

(10) Patent No.: US 6,412,957 B1
(45) Date of Patent: Jul. 2, 2002

(54) PAVEMENT MARKING ARTICLE AND METHOD OF PRODUCING

(75) Inventor: Hitoshi Oba, Yamagata-pref. (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/531,354

(22) Filed: Mar. 20, 2000

(51) Int. Cl.[7] ..... G02B 5/128

(52) U.S. Cl. ..... 359/536; 359/540; 359/542; 404/12

(58) Field of Search ..... 359/515, 534–538, 359/540, 542, 543, 546–547, 551–552, 529–532; 404/12, 16

(56) References Cited

U.S. PATENT DOCUMENTS

| | | | | |
|---|---|---|---|---|
| 3,782,843 A | 1/1974 | Eigenmann | ..... | 404/9 |
| 4,681,401 A | 7/1987 | Wyckoff | | |
| 5,777,791 A | 7/1998 | Hedblom | ..... | 359/536 |

FOREIGN PATENT DOCUMENTS

| | | |
|---|---|---|
| EP | 0 232 980 | 8/1987 |
| EP | 0 237 315 | 9/1987 |
| EP | 0 346 021 | 12/1989 |
| EP | 0 683 268 | 11/1995 |
| GB | 2 165 773 | 4/1986 |
| JP | 3224903 | 10/1991 |
| JP | 6280221 | 10/1994 |
| JP | 6330510 | 11/1994 |
| JP | 7197407 | 8/1995 |
| JP | 9041331 | 2/1997 |
| JP | 9279516 | 10/1997 |

*Primary Examiner*—James Phan
(74) *Attorney, Agent, or Firm*—Carolyn A. Fischer

(57) ABSTRACT

The pavement marking article comprises a substrate, a plurality of protrusions provided on the surface of the substrate, and first transparent microspheres having a refractive index of not less than 2.0 fixed at least on the surface of the substrate between adjacent protrusions.

15 Claims, 3 Drawing Sheets

PAVEMENT MARKING ARTICLE AND METHOD OF PRODUCING

This application claims priority from Japanese Serial No. 11-083607, filed Mar. 26, 1999.

1. Field of the Invention

The present invention relates to a pavement marking article and, more particularly, to a pavement marking article capable of affording retroreflection in wet or rainy weather as well as dry conditions. The present invention also relates to a process for producing the pavement marking article.

2. Background of the Invention

A pavement marking article is provided at a predetermined portion on a road, for example, at a center line or pedestrian crossing. In a conventional pavement marking article, visibility in the nighttime may be provided by providing transparent microspheres for retroreflection on the surface. The transparent microspheres are usually attached to the substantially flat surface of the pavement marking article to form a retroreflective pavement marking article. However, conventional retroreflective marking article may have the drawback that retroreflection is lowered in rainy weather. Because water adheres to the transparent microspheres of the pavement marking article in the rain so that the direction of light, which is incident upon the reflected surface of the microspheres, is changed and desired reflection of light is not obtained. It has been confirmed that the direction of light is markedly changed when the transparent microspheres are covered with water. Accordingly, it is desirable that water be removed from the transparent microspheres.

To remove water from the transparent microspheres, various attempts have been made. For example, Japanese Unexamined Patent Publication (KOKAI) No. 3-224903 discloses a pavement marking article comprising a pavement marking substrate having a lot of pores. This pavement marking substrate has rainwater permeability because of its pores. Accordingly, water accumulated on the surface of the pavement marking substrate or pavement marking article is absorbed by the pores on the road surface, thereby to flow away.

Japanese Unexamined Patent Publication (KOKAI) No. 9-41331 discloses a pavement marking article configured as a marking line having a regular or irregular triangle or hexagon as a basic shape in the cross section of the road in the width direction, said marking line being a broken line to act as a waterway which makes it possible to conduct prevention of flooding and retroreflection. That is, this pavement marking article is intended to remove water along its inclined portion and waterway.

Furthermore, Japanese Unexamined Patent Publication (KOKAI) No. 7-197407 discloses a pavement marking article comprising a lustrous material (glass beads) having light scattering and retroreflection properties fixed on the surface in the raised form. That is, this pavement marking article makes it possible to prevent the whole article from covered with water by making the lustrous material protrude.

Similar to this publication, Japanese Unexamined Patent Publication (KOKAI) No. 6-330510 also discloses a pavement marking article wherein plural convex-shaped microspheres having transparent microspheres are provided on the surface at a predetermined distance to prevent the whole convex-shaped microspheres from being covered with water.

Japanese Unexamined Patent Publication (KOKAI) No. 6-280221 also discloses a pavement marking article wherein an irregular pattern is formed alternatively on the surface on which transparent microspheres are fixed to prevent the whole transparent microspheres from being covered with water on wetting.

Regarding the pavement marking articles described in the above publications, the effect of removing water is expected. In the case of these pavement marking articles, however, water can not be removed completely from the surface thereof, because water remains as a water film on a part of the surface of a usual pavement marking article and, as a result, water adheres to the transparent microspheres. Accordingly, retroreflection is lowered by the presence of water and visibility of the pavement marking article in case of rainy weather is deteriorated compared with the case of fine weather.

On the other hand, a pavement marking article disclosed in Japanese Unexamined Patent Publication (KOKAI) No. 9-279516 comprises glass beads having a refractive index of 1.9 to 2.5, which is higher than that of the above transparent microspheres used for the purpose of removing water. Such glass beads having high refractive index can correct the direction of light so that it can afford retroreflection even if water adheres thereon in case of rainy weather.

Generally, the glass beads having a refractive index of 1.9 to 2.5 are liable to be broken because of comparatively low hardness. The above publications disclose that these glass beads have a particle diameter of 106 to 850 $\mu$m and are uniformly provided with protruding in the largest degree on a comparatively flat crude surface. Accordingly, when the glass beads are provided with protruding in the largest degree, as described above, the pavement marking article is liable to receive an impact frequently by comings and goings of automobiles and pedestrians and, therefore, the shape can not be retained only a comparatively short period of time. As a result, this marking article can not afford retr6reflection for a long period of time.

SUMMARY OF THE INVENTION

The present invention seeks a pavement marking article capable of affording retroreflection in wet or rainy weather.

According to one aspect, the present invention provides a pavement marking article comprising a substrate, a plurality of protrusions provided on the surface of the substrate, and first transparent microspheres having a refractive index of not less than 2.0 fixed at least on the surface of the substrate between adjacent protrusions.

According to another aspect, the present invention provides a process for producing a pavement marking article comprising a substrate, a plurality of protrusions provided on the surface of the substrate, and first transparent microspheres having a refractive index of not less than 2.0 fixed at least on the surface of the substrate between adjacent protrusions, which comprises the steps of molding a material capable of being thermally plastically deformed, thereby to form a substrate; preparing a molding die with a plurality of through openings, and coating the first transparent microspheres having a refractive index of not less than 2.0 on at least the surface of the molding die; and pressing the surface coated with the transparent microspheres of the molding die against one surface of the substrate, thereby transferring the first transparent microspheres to the substrate with forcing a part of the substrate into the openings of the molding die.

BRIEF DESCRIPTION OF THE DRAWINGS

The invention will be further explained with reference to the figures wherein.

Figure 1:
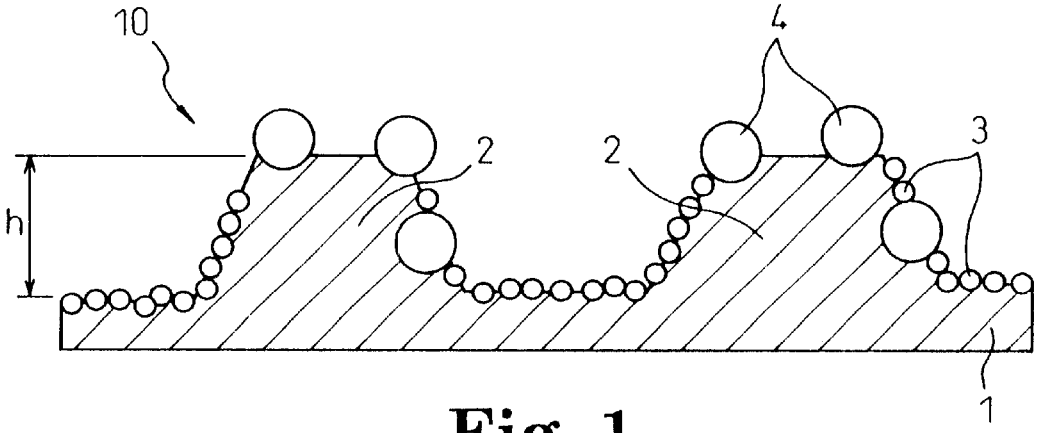
FIG. 1 is an enlarged sectional view showing one preferred embodiment of the pavement marking article according to the present invention.

These figures are intended to be merely illustrative, are not to scale, and are non-limiting.

DETAILED DESCRIPTION OF THE INVENTION

Preferred embodiments of the present invention will be described below.

A pavement marking article of the present invention comprises a substrate, a plurality of protrusions provided on the surface of the substrate and first transparent microspheres having a refractive index of not less than 2.0 fixed at least on the surface of the substrate between adjacent protrusions, as described above.

Suitable first transparent microspheres include those affording retroreflection in the pavement marking article of the present invention. Preferably first transparent microspheres comprise glass beads. The refractive index of the first transparent microspheres is at least 2.0, and is preferably from 2.2 to 2.6. When the refractive index is smaller than 2.0, the desired retroreflection efficiency may not be obtained.

The average particle diameter of the first transparent microspheres can vary widely according to the desired effect, but is preferably from about 0.02 to 1.00 mm. When the average particle diameter of the first transparent microspheres is smaller than 0.02 mm, the retroreflection efficiency may be lowered. On the other hand, when the average particle diameter of the first transparent nicrospheres is larger than about 1.00 mm, the particles may receive a large impact from an automobile and may be peeled off or come off from the surface of the substrate.

The first transparent microspheres are located at least between protrusions arranged adjacent to the surface of the substrate, that is, in a portion of the valley between the protrusions. It is preferred that the first transparent microspheres are also provided on the side of the protrusions. The first transparent microspheres can be fixed sparsely or densely according to the desired effect, but are preferably provided in a density of about 10 to 400 g/m$^2$. When the distribution density of the first transparent microspheres is smaller than about 10 g/m$^2$, the retroreflection efficiency may be lowered. On the other hand, when it is larger than about 400 g/m$^2$, inhibition of retroreflection due to shadowing of microspheres by other microspheres may occur.

Suitable substrates for the pavement marking article of the present invention may be selected with reference to the placement and use of the pavement marking article. Generally, the substrate can be formed of a material capable of being thermally plastically deformed, for example, natural or synthetic rubber or resin to provide the protrusions on the surface of the substrate. Suitable material for substrate is not limited to, but includes acrylonitrile-butadiene ;,opolymer, neoprene, polyacrylate, natural rubber or styrene-butadiene copolymer, or an unvulcanized rubber comprising at least one of these materials.

In addition, the substrate used in the present invention may be formed from a thermally and/or optically curable material, if desired. The curaule material may impart improved durability to the substrate.

It is preferred that the protrusions provided on the surface of the substrate are provided integrally with the substrate, in other words, molded integrally during the processing of the substrate. However, the protrusions may also be formed independently and may comprise a material in which is the same as or different from the material of the substrate. In the case of the latter, for example, protrusions can be attached to the surface of the substrate by using any suitable means, for example, with an adhesive.

In the case of providing the protrusions on the surface of the substrate, a plurality of protrusions can be provided in various patterns. Suitable pattern of the protrusions to be provided includes, for example, plural stripes, plural circular blocks, plural rectangular blocks or a combination thereof. Selection of a pattern may depend on the state or nature of water draining from the resulting pavement marking article. As far as an adverse influence is not exerted on the effect of the present invention, other shapes may also be used in addition to these exemplified alone or in combination with each other and those exemplified.

The size of each of the protrusions is not specifically limited and can vary widely. The height of the protrusions from the surface of the substrate is preferably within a range from about 0.5 to 2.0 mm. When the height of the protrusions is lower than about 0.5 mm, the retroreflection efficiency of first and second microspheres may be lowered. On the other hand, when the height of the protrusions exceeds about 2.0 mm, the material cost of the substrate may be high. The first transparent microspheres are provided generally at the concave portion of the protrusions so that that the height of the protrusions is preferably larger than the average particle diameter of the first transparent microspheres.

In the pavement marking article of the present invention, second transparent microspheres having a refractive index of not less than, 1.5 are preferably provided at a free end of the protrusions, that is, on top of the protrusions, in addition to the above first transparent microspheres. The second transparent may be also provided on the side of the protrusions, if desired.

The second transparent microspheres are those used for the purpose of affording retroreflection to the pavement marking article even when water is not adhered, thereby making it possible to afford visibility even in case of fine weather and to solve the problem of surface friction of the pavement marking article, and is preferably made of glass beads. The refractive index of the second transparent microspheres is at least 1.5. When the refractive index of the second transparent microspheres is smaller than 1.5, the effect described above may not be obtained. The refractive index of the second transparent microspheres is preferably within a range from 1.5 to 2.0.

The average particle diameter of the second transparent microspheres can vary widely according to the desired effect, but is preferably from about 0.02 to 1.00 mm. When particle diameter of the second transparent microspheres is smaller than 0.02 mm, the slip resistance may be lowered.

On the other hand, when the particle diameter of the second transparent microspheres is larger than about 1.00 mm, the particles may be peeled off and come off from the surface of the substrate due to an impact from the running automobiles.

The second transparent microspheres, for example, glass beads, are generally fixed at least between protrusions arranged adjacent to the surface of the substrate, that is, in the portion of the valley between the protrusions. It is preferred that the second transparent microspheres are also provided on the side of the protrusions. The second transparent microspheres can be fixed sparsely or densely according to the desired effect, but is preferably provided at the density of about 10 to 400 g/m$^2$. When the distribution density of the second transparent microspheres is smaller than about 10 g/m$^2$, the retroreflection efficiency and slip resistance in case of fine weather are lowered, sometimes. On the other hand, when it is larger than about 400 g/m$^2$, inhibition of retroreflection due to the microspheres themselves occurs.

The second transparent microspheres have a Mohs hardness of at least 6.5, preferably from about 7 to 12, so as to avoid breakage caused by comings and goings of automobiles and pedestrians. When the hardness of the second transparent microspheres is smaller than the above lower limit of the second transparent microspheres, not only breakage can not be avoided, blit also it becomes impossible to afford the slip resistance to the surface of the pavement marking article.

The pavement marking article of the present invention car.pbe applied to the predetermined portion of the road in various patterns. The pavement marking article is usually used as a marking line, for example, center line, pavement display mark, direction display mark, control display mark, etc. and, therefore, it can have a pattern suited for application. Generally, the pavement marking article is provided to form a linear pattern from a planar point of view. The linear pattern includes, for example, straight line, broken line or a combination thereof.

The pavement marking article of the present invention can be preferably produced according to the following steps of:

(1) molding a material capable of causing thermally plastic deformation, thereby to form a substrate;

(2) preparing a molding die with a plurality of through openings, and coating the first transparent microspheres having a refractive index of not less than 2.0 on at least the surface of the molding die; and (3) pressing the surface coated with the transparent micros heres of the molding die against one surface of the substrate, thereby transferring the first transparent microspheres to the substrate with forcing a part of the substrate into the openings of the molding die.

The respective steps can be carried out according to various techniques as described in detail below with reference to the accompanying drawings.

In the working of the process according to the present invention, it is particularly preferred that the openings of the molding die to be used are arranged in a pattern corresponding to the protrusions provided on the surface of the substrate and have the shape and size corresponding to the protrusions.

It is preferred that the substrate molding step further comprises a step of coating the second transparent microspheres having a refractive in dex of not less than 1.5 to the surface of the substrate to be contacted with the molding die, in addition to the molding of the substrate itself. This coating step of the second transparent microspheres can be carried out at any time before, during or after the molding of the substrate.

Subsequently, particularly preferred embodiments of the present invention will be described with reference to the accompanying drawings. It will be apparent to a person with ordinary skill that the embodiments shown in the drawings are illustrative and the present invention is not limited thereto.

FIG. 1 shows a pavement marking article as one preferred embodiment of the present invention. This pavement marking article 10 comprises a substrate 1 provided with a plurality of protrusions 2 on one surface. In the case of the embodiment shown in the drawing, the protrusions 2 have a sectional shape of trapezoid but the shape can be any shape. As described hereinafter, the protrusions 2 are preferably molded integrally with the substrate 1, using the same material. The substrate 1 is preferably made of a thermoplastic resin capable of causing plastic deformation. Such a substrate resin is, for example, commercially available from Shingo Kizai Co., Ltd. under the trade designation of "Bonline".

In the case of the pavement marking article 10 according to the present invention, a plurality of protrusions 2 are provided adjacently on the surface of the substrate 1 and first transparent microspheres 3 having a refractive index of not less than 2.0 are fixed at least between adjacent protrusions 2, that is, on the surface of the substrate 1 between the protrusions 2. These first transparent microspheres 3 can afford more efficient retroreflection performance to the pavement marking article when water is adhered thereon in case of rainy weather.

Describing in detail, the height, h, of adjacent protrusions 2 is preferably larger than the particle diameter of the first transparent microspheres 3. In the case of this embodiment, the protrusions 2 of the pavement marking article 10 have a direct impact by comings and goings of automobiles and pedestrians. On the other hand, the first transparent microspheres 3 between the protrusions 2 are located at the valley between the protrusions 2 and, therefore, such the impact is avoided. As described previously, when the first transparent microspheres 3 are made of glass beads, the microspheres generally have low hardness and are broken by an impact, comparatively easily. However, in the case of the pavement marking article 10 of the present invention, since the impact caused by comings and goings of automobiles and pedestrians can be avoided by the first transparent microspheres as described above, the breakage is prevented, thereby making it possible to retain the shape for a long period of time. As a result, the pavement marking article 10 of the present invention can afford efficient retroreflection in case of rainy weather for a long period of time. That is, in the case of the pavement marking article 10 of the present invention, the visibility can be retained for a markedly long period of time in comparison with a conventional pavement marking article.

In the pavement marking article 10 of the present invention, the protrusions 2 on the surface of the substrate 1 preferably have a height, h, of 0.5 to 2.0 mm, and the first transparent microspheres 3 preferably have a particle diameter of 0.02 to 1.00 mm.

The pavement marking article 10 shown in the drawing further comprises second transparent microspheres 4 having a refractive index of not less than 1.5 at least on a free end (top of, in this case, a trapezoidal section) of the protrusions 2. The second transparent microspheres 4 can afford retroreflection to the pavement marking article 10 when water is not attached thereon. As a result, this pavement marking article can obtain the visibility even in case of fine weather. Desirable second transparent microspheres 4 have a Mohs hardness of at least 6.5, thereby making it possible to afford slip resistance to the pavement marking article. These second transparent microspheres are, for example, commercially available from Gakunan Koki Co., Ltd. under the trade designation "Glass Beads for Blasting". The second transparent microspheres preferably have a particle diameter of 0.02 to 1.00 mm.

Preferably, the pavement marking article 10 shown in FIG. 1 can be advantageously produced in accordance with the production process described below with reference to FIG. 2 to FIG. 4.

Figure 2A:
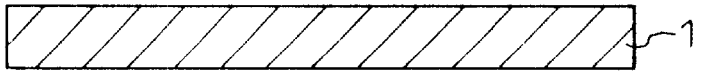
FIG. 2 is a sectional view showing a first step of preferred process for producing the pavement marking article of FIG. 1.
Figure 2B:
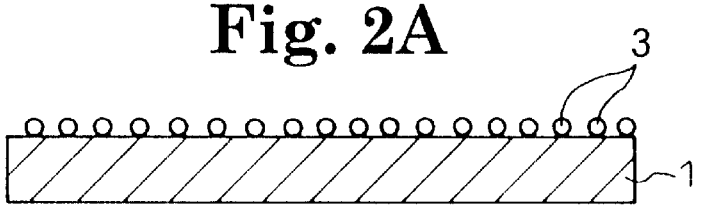

First, as shown in FIG. 2(A), a flat substrate 1 capable of causing plastic deformation by heating is prepared and then heated to the temperature enough to cause plastic deformation. Then, as shown in FIG. 2(B), the transparent microspheres 3 are uniformly spread on one surface (top surface in the case of the embodiment shown in the drawing) of this substrate 1 and then fiked in the state of being embedded partially.

Figure 3A:
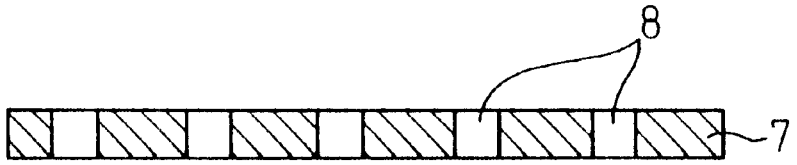
FIG. 3 is a sectional view showing a second step of preferred process for producing the pavement marking article of FIG. 1.
Figure 3B:
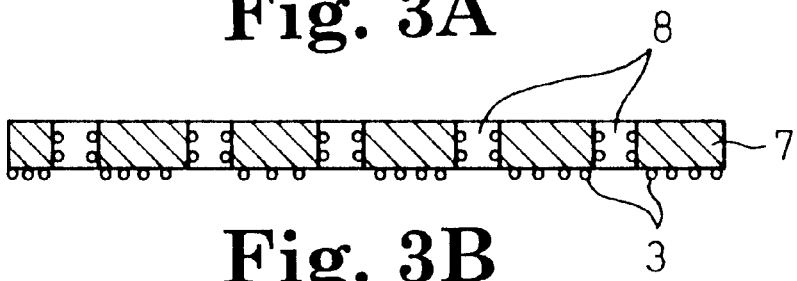

Then, as shown in FIG. 3(A), a molding die 7 with a plurality of through openings 8 is prepared. Such a molding die is not specifically limited and it is possible to optionally select the shape and size, which are suited to the pavement marking article to be produced. Therefore, a plate-shaped molding die is used in the embodiment shown in the drawing. In such a case, the molding die is commercially available from constituent parts of an embossing machine such as so-called musher. Then, as shown in FIG. 3(B), the first transparent microspheres 3 having a refractive index of not less than 2.0 are coated on the plate-shaped molding die 7, after the die 7 is dipped in a water bath. The first microspheres 3 are bonded to the die 7 by water, and, as a result, there can obtained the state where the transparent microspheres 3 are adhered to one surface (surface to be contacted with the surface retaining the transparent microspheres 4 of the substrate 1 in the subsequent step) of the molding die 7 and the inside wall of the openings 8.

Figure 4A:
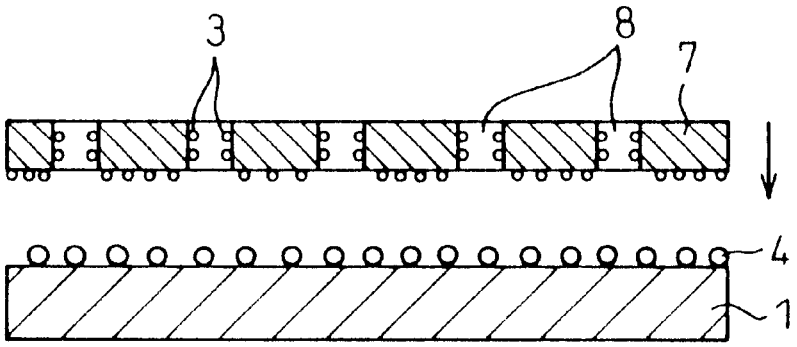
FIG. 4 is a sectional view showing a third step of preferred process for producing the pavement marking article of FIG. 1.

Subsequently, as shown in FIG. 4(A), the surface retaining the transparent microspheres 3 of the molding die 7 is pressed against the surface retaining the transparent microspheres 4 of the substrate 1 (see arrow), thereby forcing a part of the substrate into openings 8. As a result, the protrusions 2 and substrate 1 are integrally molded and, at the same time, the first transparent microspheres 3 are transferred to the surface of the substrate from the surface of the inolding die 7. The transparent microspheres 4 fixed on the surface of the substrate 1 are kept as they are and, therefore, the transparent microspheres 4 are partially retained at a top of the formed protrusions 2.

Particularly, when the molding die 7 used is made of a plate-shaped member as shown in the drawing, one surface of the die can be uniformly pressed. As a result, the fist transparent microspheres 3 can be uniformly transferred to the substrate with keeping the protrusions 2 being in almost the same shape. As shown in FIG. 3(B), when the first transparent microspheres 3 are also coated to the inside of the openings 8 of the molding die 7, the first transparent microspheres 3 can be attached to not only the surface between the protrusions 2 of the substrate, but also the side of the protrusions 2.

Figure 4B:
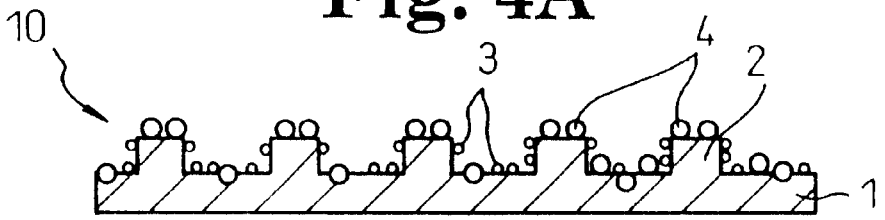

Subsequently, when the substrate 1 is cooled to room temperature and the molding die 7 is removed from the substrate 1, a pavement marking article 10 having the desired shape and size can be obtained as shown in FIG. 4(B).

The present invention was described above in accordance with the preferred embodiments thereof However, the present invention is not limited thereto. For example, the first transparent microspheres may or may not be broken in the above embodiments. First transparent microspheres having a hardness, which is comparatively higher than that of normal transparent microspheres, may also be used and it may be possible to provide such first transparent microspheres at a free end of the protrusions by coating on one surface of the substrate, together with the second transparent microspheres. In that case, even if the first transparent microspheres receive a pressure from the plate and an impact by comings and goings of automobiles and pedestrians, the microspheres are not easily broken. As a result, the first transparent microspheres spread over one surface of the pavement marking article, thereby making it possible to afford higher visibility to the pavement marking article in case of rainy weather.

Furthermore, it is not an essential feature that the protrusions are integrally molded the substrate. Therefore, the protrusions may also be attached to one surface of the substrate by using a fixing means such as adhesive.

Figure 5:
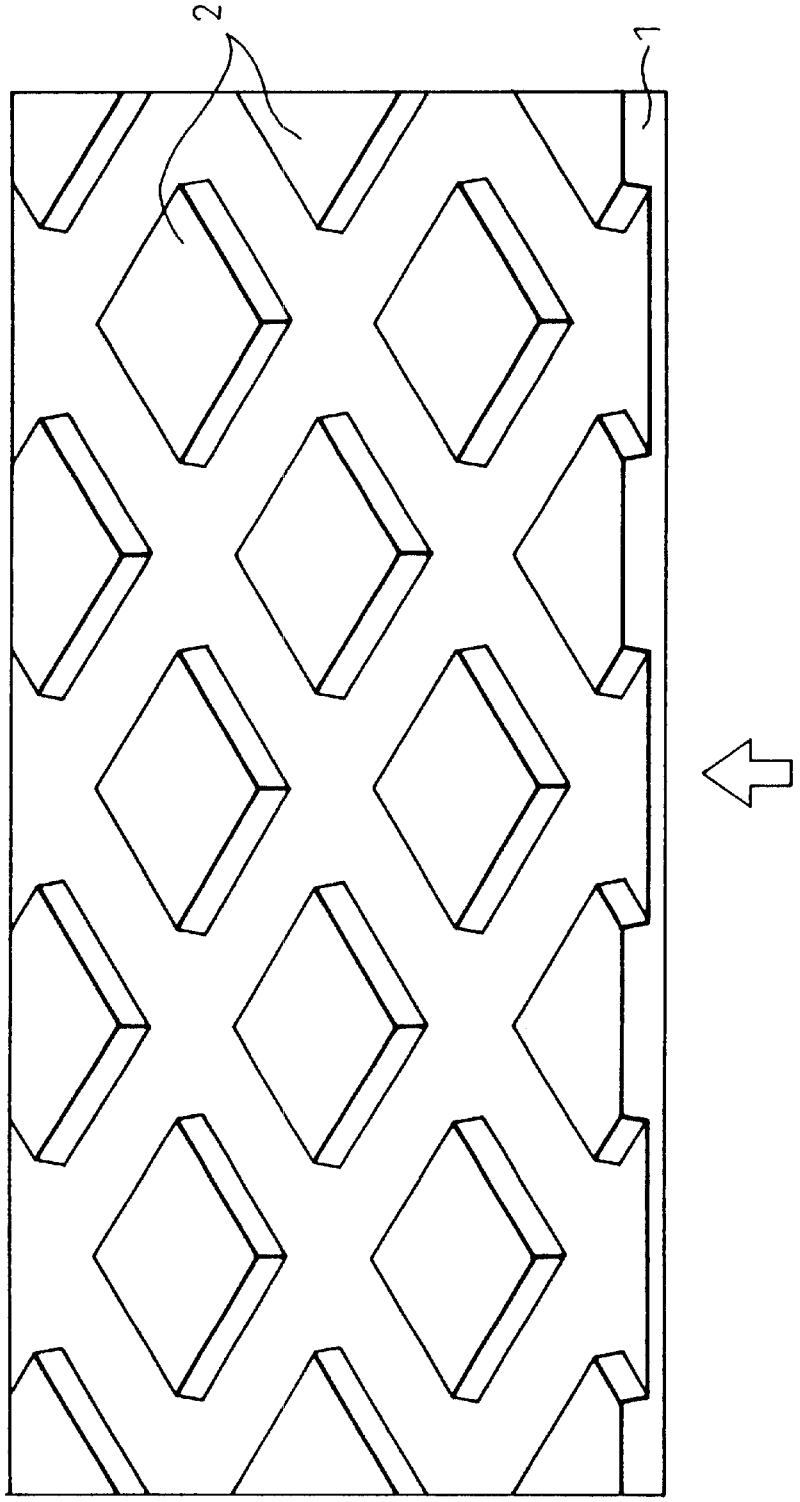
FIG. 5 is a perspective view showing one preferred embodiment of the substrate with protrusions which can be used advantageously in the production of the pavement marking article according to the present invention.

As shown in FIG. 5, the substrate 1 may also be those obtained by integrally molding with a plurality of protrusions 1 at a predetermined distance, previously. The shape of the protrusions is described in detail in Japanese Examined Patent Publication (KOKOKU) No. 3-52344. It is preferred that such a substrate is preferably made of an unvulcanized rubber containing at least one of acrylonitrile-butadiene copolymer, neoprene, polyacrylate, natural rubber and styrene-butadiene copolymer and has pliability, thereby affording viscoelasticity. This viscoelasticity makes it possible to absorb a force and a pressure of vehicles and road traffic without causing an internal force which is liable to remove the pavement marking article from the road. Furthermore, in the case of the pavement marking article as shown in the drawing, when comings and goings of automobiles or pedestrians are present in the direction shown by arrow in the drawing, that is, when the pedestrians come and go in the direction vertical to the flow direction of the pavement marking article, there is such an effect that the protrusions become unobtrusive and the visibility is more improved because the clearance between the protrusions is eliminated.

When the substrate is made of the unvulcanized rubber, the first transparent microspheres are usually provided through a fixing layer. Preferred fixing layer is, as described in Japanese Unexamined Patent Publication (KOKAM) No. 2-38605, made of a thermoplastic or thermosetting polymer binder. Such a binder includes, for example, vinyl-based thermoplastic resin, polyurethane resin or epoxy-based resin. A general fixing layer further containing, as a pigment, particles of titanium oxide dispersed uniformly therein. Such particles of titanium oxide afford a function of good reflection to the fixing layer, in addition to a function as a white colorant. As a result, when light from a head-lamp of the automobile is incident upon the pavement marking article, light can be retro-reflected at a wide viewing angle to reach a driver. Accordingly, the particles of titanium oxide can afford higher visibility to the pavement marking article. The pigment used herein is not limited to the above-mentioned titanium oxide. Other effective pigments include perlescent pigment, mirror reflection substance (e.g. aluminum powder or flake) and chrome yellow pigment. If necessary, other pigments used in the coloring of pavement marking can also be used.

EXAMPLES

The present invention will be described in detail with reference to the examples thereof Example 1

First, a melt type substrate for pavement marking article commercially available from Singo Kizai Co., Ltd. under the trade designation "Bonline", and the above-mentioned musher were prepared. The musher is that used as a molding die in this example and has a plurality of cylindrical through openings and, therefore, circular openings are exposed at both of the upper and lower surfaces.

Then, the whole molding die was wetted with water and first glass beads having a refractive index of 2.2 and an average particle diameter of 70 $\mu$m are adhered on the surface of the molding die and inside of the openings.

Then, the previously prepared substrate was molten by heating to about 150° C. Subsequently, the molten substrate was coated on a previously prepared aluminum plate having a thickness of 1 mm in a flat coating thickness of 1 mm.

Second glass beads having a refractive index of 1.5 and a particle diameter of 500 to 700 $\mu$m were spread at the density of 167 g/m$^2$ and then fixed.

Subsequently, a pressure was applied while closely contacting the surface of the molding, on which the first glass beads were adhered, with the substrate to which the second glass beads were fixed, thereby integrally molding the protrusions integrally and the substrate with protruding a part of the substrate from the openings. After the first glass beads were transferred to the substrate, the substrate was cooled to room temperature to obtain a desired pavement marking article.

Comparative Example 1

In the same manner as in Example 1, except that the first transparent microspheres are not coated on the surface of the molding die, a pavement marking article was produced.

Evaluation of visibility:

The evaluation of the visibility of the pavement marking articles produced in Example 1 and Comparative Example 1 was conducted in the following manner described in detail below.

A direct comparison between two pavement marking articles in the nighttime was made by visually observing in the automobile, which is 10 m away from the pavement marking articles, by shining light from a head-lamp. Such a direct comparison was made by observing in case of fine and rainy weathers. Furthermore, a comparison in case of rainy weather was made by. observing after the acceleration of wear of the pavement marking articles. The acceleration of wear of the pavement marking articles is conducted in accordance with an accelerated wear test method defined in Notification No. 1322 of he Ministry of Construction issued on Jul. 21, 1989, that is, the acceleration corresponding to wear of about 4,000 times of the pavement marking articles is conducted. The evaluation results made on a scale of 1 to 5 are shown in the table below, in which 5 is "excellent", 4 is "good", 3 is "fair", 2 is "poor" and 1 is "bad". That is, the evaluation on a scale of 1 to 5 was made based on a brightness of the initial retroreflection in a night/fine weather in Example 1.

| Conditions of Observation | Example 1 | Comparative Example 1 |
|---|---|---|
| Night/fine weather (initial) | 5 | 5 |
| Nighttime/rainy weather (initial) | 4 | 2 |

-continued

| Conditions of Observation | Example 1 | Comparative Example 1 |
|---|---|---|
| Night/rainy weather (initial) (after acceleration of wear) | 4 | 1 |

As is apparent from the evaluation results described above, a difference was hardly recognized between both pavement marking articles in case of fine weather. In case of rainy weather, however, the pavement marking article of Example 1 was observed with higher visibility than that of Comparative Example, 1. Particularly, when wear is accelerated, the difference became remarkable. Therefore, it became apparent that the pavement marking articles according to the present invention can afford effective retroreflection in case of rainy weather for a long period of time.

As described above, according to the present invention, there can be provided a high-performance pavement marking article free from care about breakage for a long period of time without deteriorating retroreflection even in case of wet or rainy weather by providing first transparent microspheres between at the concave portion between protrusions of the pavement marking article in a state of being protected with the protrusions.

What is claimed is:

1. A pavement marking article comprising:

a substrate, a plurality of protrusions provided on a surface of the substrate, first transparent microspheres having a refractive index of not less than 2.0 fixed at least on the surface of the substrate between adjacent protrusions, and glass beads at least at a free end of the protrusions; wherein the glass beads have a particle diameter within a range from 0.02 to 1.00 mm, a refractive index of not less than 1.5, and a Mohs hardness of 7 to 12.

2. The pavement marking article according to claim 1, wherein the first transparent microspheres are also provided on the side of the protrusions.

3. The pavement marking article according to claim 1, wherein the first transparent microspheres are glass beads and the particle diameter thereof is within a range from 0.02 to 1.00 mm.

4. The pavement marking article according to claim 3, wherein the glass beads are provided in the density of 10 to 400 g/m$^2$.

5. The pavement marking article according to claim 1, wherein the substrate is made of a material capable of being thermally plastically deformed.

6. The pavement marking article according to claim 5, wherein the material of the substrate is made of an unvulcanized rubber containing at least one of acrylonitrile-butadiene copolymer, neoprene, polyacrylate, natural rubber and styrene-butadiene copolymer.

7. The pavement marking article according to claim 1, wherein the protrusions are made of a combination of a plurality of rectangular blocks, stripes, circular blocks or combination thereof.

8. The pavement marking article according to claim 1, wherein the protrusions are provided integrally with the substrate.

9. The pavement marking article according to claim 1, wherein the height of the protrusions from the surface of the substrate is within a range from 0.5 to 2.0 mm.

10. The pavement marking article according to claim 1, which is provided to form a linear pattern from a planar point of view.

11. The pavement marking article according to claim 10, wherein the linear pattern is composed of a straight line, a broken line or a combination thereof.

12. A pavement marking article comprising:

a substrate, a plurality of protrusions provided on a surface of the substrate, first transparent microspheres having a refractive index of not less than 2.0 fixed at least on the surface of the substrate between adjacent protrusions, and glass beads at least at a free end of the protrusions; wherein the glass beads have a particle diameter within a range from 0.02 to 1.00 mm, a refractive index of not less than 1.5, and wherein the glass beads are provided in a density of 10 to 400 $g/m^2$.

13. A process for producing a pavement marking article comprising a substrate, a plurality of protrusions provided on the surface of the substrate, and first transparent microspheres having a refractive index of not less than 2.0 fixed at least on the surface of the substrate between adjacent protrusions, which comprises the steps of:

molding a material capable of being thermally plastically deformed, thereby to form a substrate;

preparing a molding die with a plurality of through openings, and coating the first transparent microspheres having a refractive index of not less than 2.0 on at least the surface of the molding die; and pressing the surface coated with the transparent microspheres of the molding die against one surface of the substrate, thereby transferring the first transparent microspheres to the substrate with forcing a part of the substrate into the openings of the molding die.

14. The process according to claim 13, wherein the openings are arranged in a pattern corresponding to the protrusions and have shape and size corresponding to the protrusions.

15. The process according to claim 13, wherein the substrate molding step further comprises the step of coating second transparent microspheres having a refractive index of not less than 1.5 on the surface of the substrate to be contacted with the molding die.

* * * * *

UNITED STATES PATENT AND TRADEMARK OFFICE

CERTIFICATE OF CORRECTION

PATENT NO. : 6,412,957 B1
DATED : July 2, 2002
INVENTOR(S) : Oba, Hitoshi

It is certified that error appears in the above-identified patent and that said Letters Patent is hereby corrected as shown below:

Column 2,
Line 35, delete “retrbreflection” and insert in place thereof -- retroreflection --.

Column 3,
Line 34, following “comprise” and before “glass” insert -- of --.
Line 46, delete “nicrospheres” and insert in place thereof -- microspheres --.

Column 4,
Line 4, delete “i,opolymer,” and insert in place thereof -- copolymer, --.
Line 9, delete “curaule” and insert in place thereof -- curable --.

Column 5,
Line 25, delete “blit” and insert in place thereof -- but --.
Line 29, delete “car.pbe” and insert in place thereof -- can be --.
Line 62, delete “in dex” and insert in place thereof -- index --.

Column 7,
Line 18, delete “fiked” and insert in place thereof -- fixed --.
Line 46, delete “inolding” and insert in place thereof -- molding --.
Line 67, after “thereof” add -- . --.

Column 8,
Line 45, delete “(KOKAM)” and insert in place thereof -- (KOKAI) --.
Line 67, after “thereof” add -- . --.

Column 9,
Line 51, delete “he” and insert in place thereof -- the --.

Signed and Sealed this

Twenty-eighth Day of January, 2003

JAMES E. ROGAN
*Director of the United States Patent and Trademark Office*